US008049672B2

(12) United States Patent
Chang et al.

(10) Patent No.: US 8,049,672 B2
(45) Date of Patent: Nov. 1, 2011

(54) ULTRA WIDEBAND ANTENNA WITH BAND-NOTCHED CHARACTERISTICS

(75) Inventors: The-Nan Chang, Taipei (TW); Min-Chi Wu, Taipei (TW)

(73) Assignees: Tatung University, Taipei (TW); Tatung Company, Taipei (TW)

( * ) Notice: Subject to any disclaimer, the term of this patent is extended or adjusted under 35 U.S.C. 154(b) by 400 days.

(21) Appl. No.: 12/314,398

(22) Filed: Dec. 10, 2008

(65) Prior Publication Data

US 2010/0066621 A1 Mar. 18, 2010

(30) Foreign Application Priority Data

Sep. 18, 2008 (TW) ..... 097135741 A

(51) Int. Cl.
*H01Q 1/38* (2006.01)
*H01Q 13/12* (2006.01)

(52) U.S. Cl. ..... 343/767; 343/700 MS; 343/769; 343/770

(58) Field of Classification Search ..... 343/700 MS, 343/767, 769, 770
See application file for complete search history.

(56) References Cited

U.S. PATENT DOCUMENTS 7,646,341 B1 * 1/2010 Lin et al. ..... 343/700 MS

OTHER PUBLICATIONS

J. Liu, Compact printed ultra-wideband monpole antenna with dual band-notched characteristics, Jun. 2008, Electronic Letters, vol. 44, No. 12.*

V. Crnojevic-Bengin, Complementary split rings resonators using square sierpinski fractal curves, Proceedings of the 36th European Microwave Conference, pp. 1333-1335.*

* cited by examiner

*Primary Examiner* — Jacob Y Choi
*Assistant Examiner* — Hasan Islam
(74) *Attorney, Agent, or Firm* — Bacon & Thomas, PLLC

(57) ABSTRACT

An ultra wideband antenna includes: a substrate; a grounding unit, installed on the substrate and scooped with a first slot and a first strip hole; a signal feeding unit, installed on the substrate and including a horizontal portion and a vertical portion, in which the horizontal portion is located in the first slot and the vertical portion is located in the first strip hole; a first complementary, separate, circular resonator; and a second complementary, separate, circular resonator, wherein the first complementary, separate, circular resonator and the second complementary, separate, circular resonator are installed in the horizontal portion of the signal feeding unit and are connected with each other.

11 Claims, 6 Drawing Sheets

ULTRA WIDEBAND ANTENNA WITH BAND-NOTCHED CHARACTERISTICS

BACKGROUND OF THE INVENTION

1. Field of the Invention

The invention relates to an ultra wideband antenna with band-notched characteristics, particularly to an ultra wideband antenna capable of suppressing transmission and reception in a particular frequency range through providing two complementary, separate, circular resonators, connected with each other, in a signal feeding unit.

2. Description of Related Art

Accompanied by rapid growth of demand of radio transmission over a short distance, wireless communication of local area networks and variety of personal mobile communication products, the quantity and speed of transmission of radio communication data are increasing. In view of that, in February, 2002, the Federal Communications Commission approved that ultra wideband technology may be used in a general commercial communication system, and regulates that ultra wideband communication is a high transmission, low power and short distance communication system. However, the frequency range of the ultra wideband (from 3.1 GHz to 10.6 GHz) includes the frequency band, such as 5.150 GHz to 5.875 GHz, used in a wireless local area network (WLAN). Thus, interference of the communication signals between the ultra wideband communication and the WLAM system will be incurred.

Therefore, in order to allow the ultra wideband communication to become more practicable, those engaged in the industry submit many solutions to suppress signals transmitted or received in the operation frequency band of the WLAN for the ultra wideband communication, so as to reduce the afore-mentioned signal interference. As described below, there are three conventional ultra wideband antennas with band-notched characteristics that are able not to transmit or receive a high frequency signal in the operation frequency band (5 GHz to 6 GHz) of the WLAN.

As shown in FIG. 1A, the first conventional ultra wideband antenna with band-notched characteristics includes a substrate 11, a grounding unit 12, a signal feeding unit 13, and a rectangular strip slot 14. The substrate 11 is preferably a microwave substrate with FR-4 material. The grounding unit 12 is installed on the substrate 11 and scooped with a first slot 121 and a first strip hole 122, in which the first strip hole 122 is communicated with the first slot 121 and extended to a side 111 of the substrate 11. In addition, the signal feeding unit 13 is installed on the substrate 11 and includes a horizontal portion 131 and a vertical portion 132, in which the horizontal portion 131 is in the first slot 121 and the vertical portion 132 is in the first strip hole 122.

As shown in FIGS. 1A and 1B, the first slot 121 of the grounding unit 12 is a rectangular strip slot and the shape of the horizontal portion 131 of the signal feeding unit 13 is rectangular. Further, the material of the grounding unit 12 and the signal feeding unit 13 is metal. Furthermore, the rectangular strip slot 14 is installed on the horizontal portion 131 of the signal feeding unit 13 and has an opening 141, in which the direction of the opening of the rectangular strip slot 14 is parallel to the extension direction of the vertical portion 132 of the signal feeding unit 13 and the length of the rectangular strip slot 14 is 21.4 mm.

Besides, the sizes of various labels for the first conventional ultra wideband antenna with band-notched characteristics as shown in FIGS. 1A and 1B are listed in the following Table 1:

TABLE 1

| label | size (mm) | label | size (mm) | label | size (mm) |
|---|---|---|---|---|---|
| L | 35 | W | 33 | Ls | 23 |
| Ws | 13 | t | 2 | Sf | 0.4 |
| Wf | 3.6 | AB | 10.8 | AE | 4 |

Therefore, in the first conventional ultra wideband antenna with band-notched characteristics, the "band-notched unit" is constituted by the rectangular strip slot 14 such that the first conventional ultra wideband antenna with band-notched characteristics is able not to transmit or receive a high frequency signal in the frequency range from 5 GHz to 6 GHz. The detailed characteristic curves, such as return loss and gain, will be shown together with those of the present invention in the following.

As shown in FIG. 2A, the second conventional ultra wideband antenna with band-notched characteristics includes a substrate 21, a grounding unit 22, a signal feeding unit 23, and a complementary, separate, circular resonator 24. The substrate 21 is preferably a microwave substrate with FR-4 material. The grounding unit 22 is installed on the substrate 21 and scooped with a first slot 221 and a first strip hole 222, in which the first strip hole 222 is communicated with the first slot 221 and extended to a side 211 of the substrate 21. In addition, the signal feeding unit 23 is installed on the substrate 21 and includes a horizontal portion 231 and a vertical portion 232, in which the horizontal portion 231 is in the first slot 221 and the vertical portion 232 is in the first strip hole 222.

As shown in FIGS. 2A and 2B, the first slot 221 of the grounding unit 22 is a rectangular slot and the shape of the horizontal portion 231 of the signal feeding unit 23 is rectangular. Further, the material of the grounding unit 22 and the signal feeding unit 23 is metal. Furthermore, the complementary, separate, circular resonator 24 is installed on the horizontal portion 231 of the signal feeding unit 23 and includes a first rectangular strip slot 241 and a second rectangular strip slot 242, in which the first rectangular strip slot 241 surrounds the second rectangular strip slot 242. The first rectangular strip slot 241 and the second rectangular strip slot 242 respectively have an opening 243 and an opening 244 and the direction of the opening of the first rectangular strip slot 241 is opposite to the direction of the opening of the second rectangular strip slot 242. Furthermore, the direction of the opening of the first rectangular strip slot 241 is parallel to the extension direction of the vertical portion 232 of the signal feeding unit 23.

Besides, the sizes of various labels for the second conventional ultra wideband antenna with band-notched characteristics as shown in FIGS. 2A and 2B are listed in the following Table 2:

TABLE 2

| label | Size (mm) | label | size (mm) | label | size (mm) |
|---|---|---|---|---|---|
| L | 35 | W | 33 | Ls | 23 |
| Ws | 13 | t | 2 | Sf | 0.4 |
| Wf | 3.6 | AB | 10.8 | AE | 4 |
| g | 0.1 | c | 0.2 | d | 0.4 |
| r | 0.9 | | | | |

Therefore, in the second conventional ultra wideband antenna with band-notched characteristics, the "band-notched unit" is constituted by the complementary, separate, circular resonator 24 such that the second conventional ultra wideband antenna with band-notched characteristics is able not to transmit or receive a high frequency signal in the frequency range from 5 GHz to 6 GHz. The detailed characteristic curves, such as return loss and gain, will be shown together with those of the present invention in the following.

As shown in FIG. 3A, the third conventional ultra wideband antenna with band-notched characteristics includes a substrate 31, a grounding unit 32, a signal feeding unit 33, a first complementary, separate, circular resonator 34 and a second complementary, separate, circular resonator 35. The substrate 31 is preferably a microwave substrate with FR-4 material. The grounding unit 32 is installed on the substrate 31 and scooped with a first slot 321 and a first strip hole 322, in which the first strip hole 322 is communicated with the first slot 321 and extended to a side 311 of the substrate 31. In addition, the signal feeding unit 33 is also installed on the substrate 31 and includes a horizontal portion 331 and a vertical portion 332, in which the horizontal portion 331 is in the first slot 321 and the vertical portion 332 is in the first strip hole 322.

As shown in FIGS. 3A and 3B, the first slot 321 of the grounding unit 32 is a rectangular slot and the shape of the horizontal portion 331 of the signal feeding unit 33 is rectangular. Further, the material of the grounding unit 32 and the signal feeding unit 33 is metal. Furthermore, the first complementary, separate, circular resonator 34 and the second complementary, separate, circular resonator 35 are installed on the horizontal portion 331 of the signal feeding unit 33, and the first complementary, separate, circular resonator 34 and the second complementary, separate, circular resonator 35 are spaced apart from a distance S in installation.

As shown in FIG. 3B, the first complementary, separate, circular resonator 34 includes a first rectangular strip slot 341 and a second rectangular strip slot 342, in which the first rectangular strip slot 341 surrounds the second rectangular strip slot 342. The first rectangular strip slot 341 and the second rectangular strip slot 342 respectively have an opening 343 and an opening 344 and the direction of the opening of the first rectangular strip slot 341 is opposite to the direction of the opening of the second rectangular strip slot 342. Furthermore, the direction of the opening of the first rectangular strip slot 341 is parallel to the extension direction of the vertical portion 332 of the signal feeding unit 33. In addition, the second complementary, separate, circular resonator 35 includes a third rectangular strip slot 351 and a fourth rectangular strip slot 352, in which the third rectangular strip slot 351 surrounds the fourth rectangular strip slot 352. The third rectangular strip slot 351 and the fourth rectangular strip slot 352 respectively have an opening 353 and an opening 354 and the direction of the opening of the third rectangular strip slot 351 is opposite to the direction of the opening of the fourth rectangular strip slot 352. Furthermore, the direction of the opening of the first rectangular strip slot 341 is parallel to the direction of the opening of the third rectangular strip slot 351.

Besides, the sizes of various labels for the third conventional ultra wideband antenna with band-notched characteristics as shown in FIGS. 3A and 3B are listed in the following Table 3:

TABLE 3

| label | Size (mm) | label | size (mm) | label | size (mm) |
|---|---|---|---|---|---|
| L | 35 | W | 33 | Ls | 23 |
| Ws | 13 | t | 2 | Sf | 0.4 |
| Wf | 3.6 | AB | 10.8 | AE | 4 |
| g | 0.1 | c | 0.2 | d | 0.4 |
| r | 0.9 | S | 0.2 | | |

Therefore, in the third conventional ultra wideband antenna with band-notched characteristics, the "band-notched unit" is constituted by that the first complementary, separate, circular resonator 34 and the second complementary, separate, circular resonator 35 are spaced apart from a distance S in installation, such that the third conventional ultra wideband antenna with band-notched characteristics is able not to transmit or receive a high frequency signal in the frequency range from 5 GHz to 6 GHz. The detailed characteristic curves, such as return loss and gain, will be shown together with those of the present invention in the following.

As described above, in the three conventional ultra wideband antennas with band-notched characteristics, either the suppression ability of the "band-notched unit" is insufficient, or the "band-notched unit" occupies a big area of the substrate. Therefore, it is necessary in the industry to have an ultra wideband antenna with band-notched characteristics, having better suppression ability and occupying a smaller substrate area.

SUMMARY OF THE INVENTION

It is an objective of the invention to provide an ultra wideband antenna with band-notched characteristics, capable of suppressing transmission and reception of a high frequency signal in a particular frequency range, such as a frequency band in a WLAN.

It is further an objective of the invention to provide an ultra wideband antenna with band-notched characteristics, in which the "band-notched unit" occupies a small substrate area.

In order to accomplish the above objectives, the invention provides an ultra wideband antenna with band-notched characteristics, comprising: a substrate; a grounding unit, installed on the substrate and scooped with a first slot and a first strip hole, the first strip hole being communicated with the first slot and extended to a side of the substrate; a signal feeding unit, installed on the substrate and including a horizontal portion and a vertical portion, in which the horizontal portion is located in the first slot and the vertical portion is located in the first strip hole; a first complementary, separate, circular resonator; and a second complementary, separate, circular resonator, in which the first complementary, separate, circular resonator and the second complementary, separate, circular resonator are installed in the horizontal portion of the signal feeding unit, and are connected with each other.

In the ultra wideband antenna with band-notched characteristics of the invention, due to that the first complementary, separate, circular resonator and the second complementary, separate, circular resonator are installed in the horizontal portion of the signal feeding unit and are connected with each other to form a "band-notched unit", the invention will be able not to transmit or receive a high frequency signal in the frequency range from 5 GHz to 6 GHz. Thus, in operation, the ultra wideband antenna with band-notched characteristics of the invention will not interfere with the WLAN system. Further, in the ultra wideband antenna with band-notched characteristics of the invention, since the first complementary, separate, circular resonator and the second complementary, separate, circular resonator are connected with each other, the substrate area occupied by the "band-notched unit" of the invention is smaller that that of the conventional ultra wideband antennas with band-notched characteristics.

Other objects, advantages, and novel features of the invention will become more apparent from the following detailed description when taken in conjunction with the accompanying drawings.

DETAILED DESCRIPTION OF THE PREFERRED EMBODIMENT

Figure 4A:
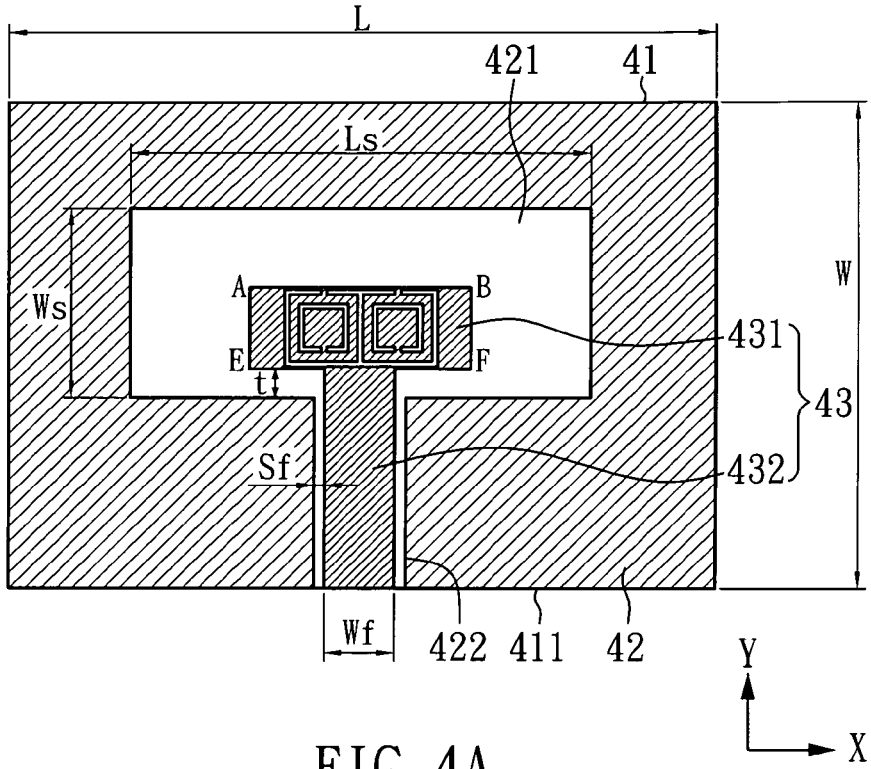
FIG. 4A is a schematic diagram showing an ultra wideband antenna with band-notched characteristics of the invention.

As shown in FIG. 4A, the ultra wideband antenna with band-notched characteristics of the invention comprises: a substrate 41, a grounding unit 42, a signal feeding unit 43, a first complementary, separate, circular resonator 44 and a second complementary, separate, circular resonator 45. The substrate 41 is preferably a microwave substrate with FR-4 material. The grounding unit 42 is installed on the substrate 41 and scooped with a first slot 421 and a first strip hole 422, in which the first strip hole 422 is communicated with the first slot 421 and extended to a side 411 of the substrate 41. In addition, the signal feeding unit 43 is also installed on the substrate 41 and includes a horizontal portion 431 and a vertical portion 432, in which the horizontal portion 431 is in the first slot 421 and the vertical portion 432 is in the first strip hole 422.

As shown in FIG. 4A, the first slot 421 of the grounding unit 42 is a rectangular slot and the shape of the horizontal portion 431 of the signal feeding unit 43 is rectangular. Further, the material of the grounding unit 42 and the signal feeding unit 43 is metal. Furthermore, the first complementary, separate, circular resonator 44 and the second complementary, separate, circular resonator 45 are installed on the horizontal portion 431 of the signal feeding unit 43, and the first complementary, separate, circular resonator 44 and the second complementary, separate, circular resonator 45 are connected with each other.

Figure 4B:
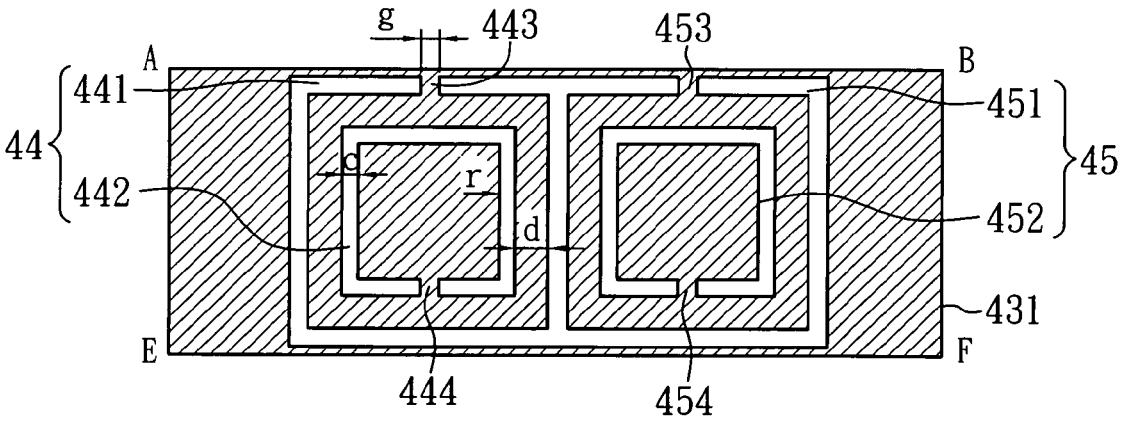
FIG. 4B is a schematic diagram showing a "band-notched unit" of the ultra wideband antenna with band-notched characteristics of the invention.

As shown in FIG. 4B, the first complementary, separate, circular resonator 44 includes a first rectangular strip slot 441 and a second rectangular strip slot 442, in which the first rectangular strip slot 441 surrounds the second rectangular strip slot 442. The first rectangular strip slot 441 and the second rectangular strip slot 442 respectively have an opening 443 and an opening 444 and the direction of the opening of the first rectangular strip slot 441 is opposite to the direction of the opening of the second rectangular strip slot 442. Furthermore, the direction of the opening of the first rectangular strip slot 441 is parallel to the extension direction of the vertical portion 432 of the signal feeding unit 43. In addition, the second complementary, separate, circular resonator 45 includes a third rectangular strip slot 451 and a fourth rectangular strip slot 452, in which the third rectangular strip slot 451 surrounds the fourth rectangular strip slot 452. The third rectangular strip slot 451 and the fourth rectangular strip slot 452 respectively have an opening 453 and an opening 454 and the direction of the opening of the third rectangular strip slot 451 is opposite to the direction of the opening of the fourth rectangular strip slot 452. Furthermore, the direction of the opening of the first rectangular strip slot 441 is parallel to the direction of the opening of the third rectangular strip slot 451.

Besides, the sizes of various labels for the ultra wideband antenna with band-notched characteristics of the invention as shown in FIGS. 4A and 4B are listed in the following Table 4:

TABLE 4

| label | Size (mm) | label | size (mm) | label | size (mm) |
|---|---|---|---|---|---|
| L | 35 | W | 33 | Ls | 23 |
| Ws | 13 | t | 2 | Sf | 0.4 |
| Wf | 3.6 | AB | 10.8 | AE | 4 |
| g | 0.1 | c | 0.2 | d | 0.4 |
| r | 1.03 | | | | |

Further, as shown in FIG. 4B, the first rectangular strip slot 441 of the first complementary, separate, circular resonator 44 is communicated with the third rectangular strip slot 451 of the second complementary, separate, circular resonator 45. Thus, in the ultra wideband antenna with band-notched characteristics of the invention, the "band-notched unit" is constituted by integrating the first complementary, separate, circular resonator 44 with the second complementary, separate, circular resonator 45 into one body.

As described below, accompanied by illustration of FIGS. 5, 6 and 7, it is proved that the ultra wideband antenna with band-notched characteristics of the invention indeed is able not to transmit or receive a high frequency signal in the frequency range from 5 GHz to 6 GHz.

Figure 5:
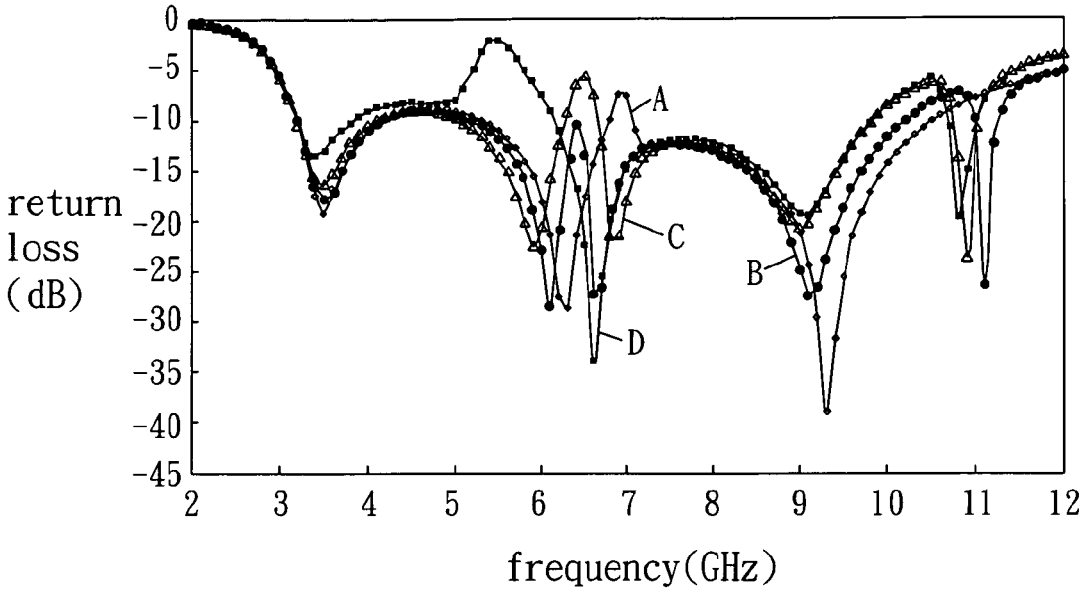
FIG. 5 is a schematic diagram showing variation of return loss in dependence of change of frequency in a frequency range from 2 GHz to 12 GHz for the three conventional ultra wideband antennas with band-notched characteristics and the ultra wideband antenna with band-notched characteristics of the invention.

FIG. 5 is a schematic diagram showing variation of return loss in dependence of change of frequency in a frequency range from 2 GHz to 12 GHz for the three conventional ultra wideband antennas with band-notched characteristics and the ultra wideband antenna with band-notched characteristics of the invention, which is obtained by simulation through CST software.

Figure 1A:
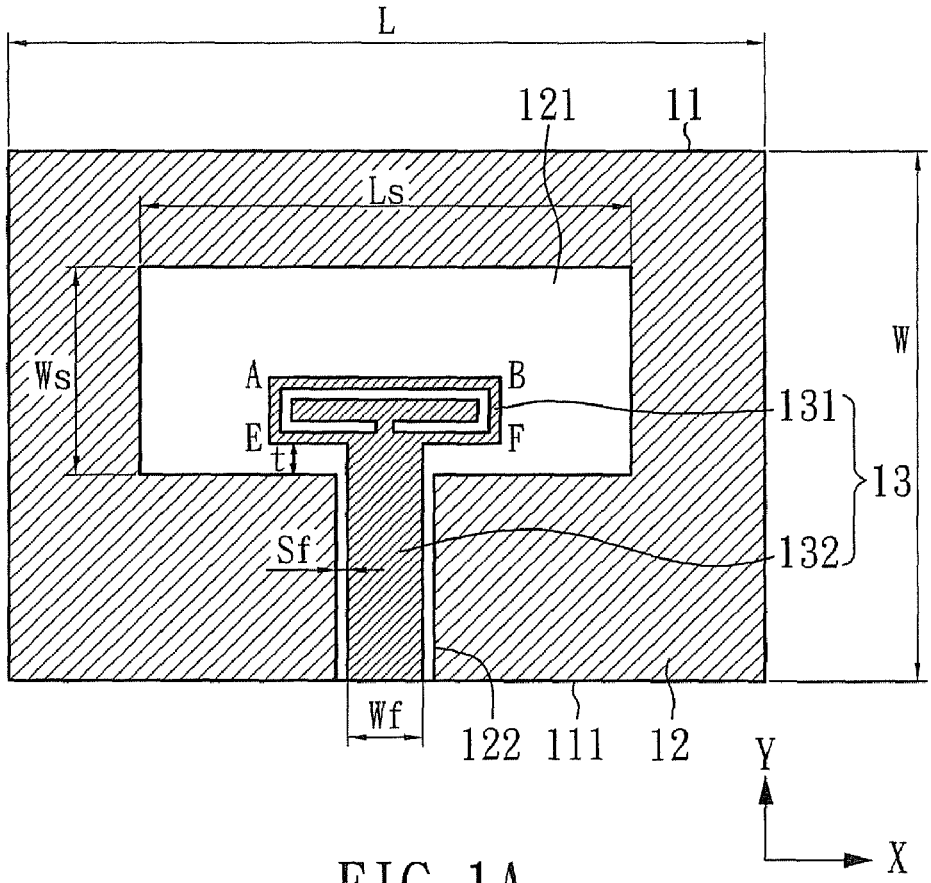
FIG. 1A (PRIOR ART)
FIG. 1A is a schematic diagram showing a first conventional ultra wideband antenna with band-notched characteristics.
Figure 1B:
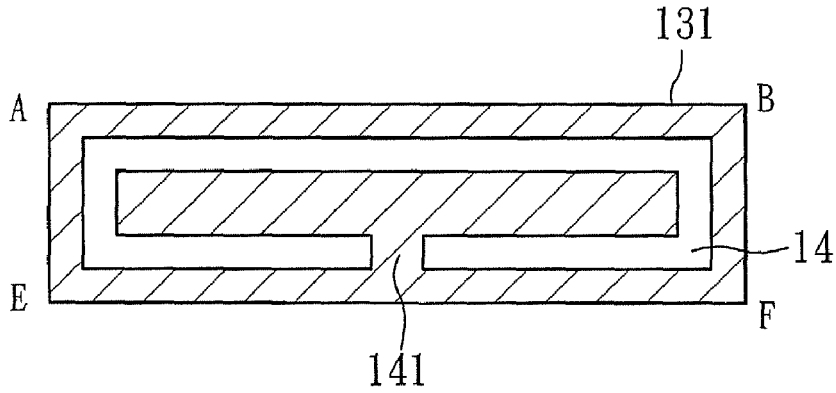
FIG. 1B (PRIOR ART)
FIG. 1B is a schematic diagram showing a "band-notched unit" of the first conventional ultra wideband antenna with band-notched characteristics.
Figure 2A:
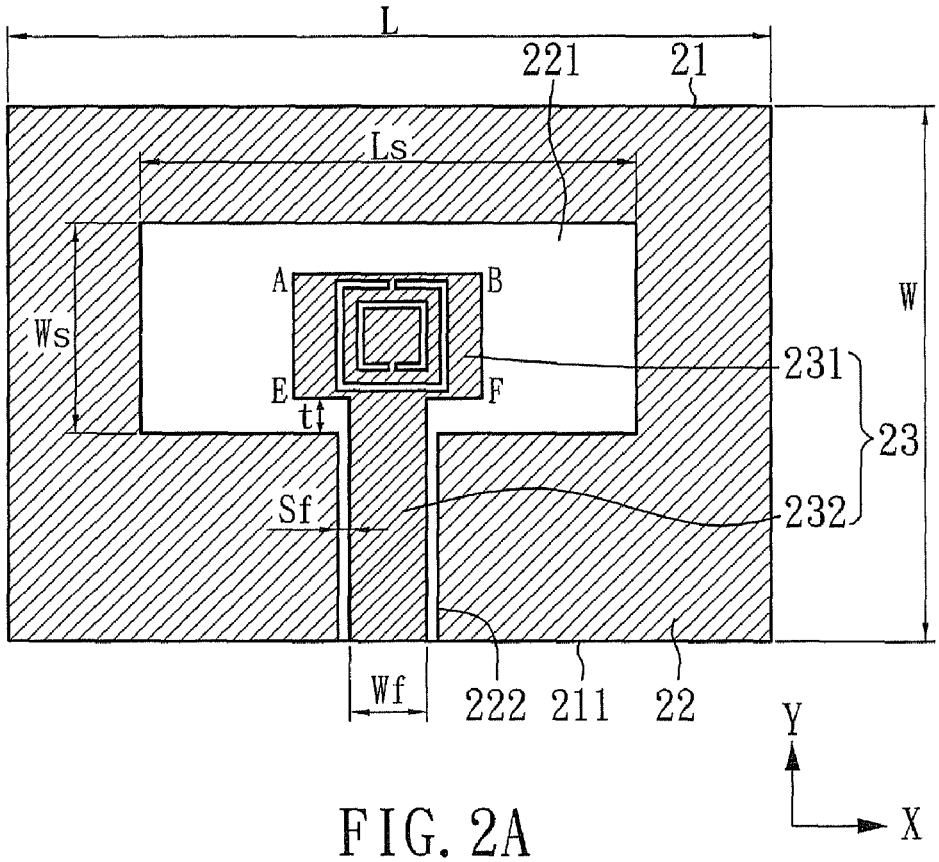
FIG. 2A (PRIOR ART)
FIG. 2A is a schematic diagram showing a second conventional ultra wideband antenna with band-notched characteristics.
Figure 2B:
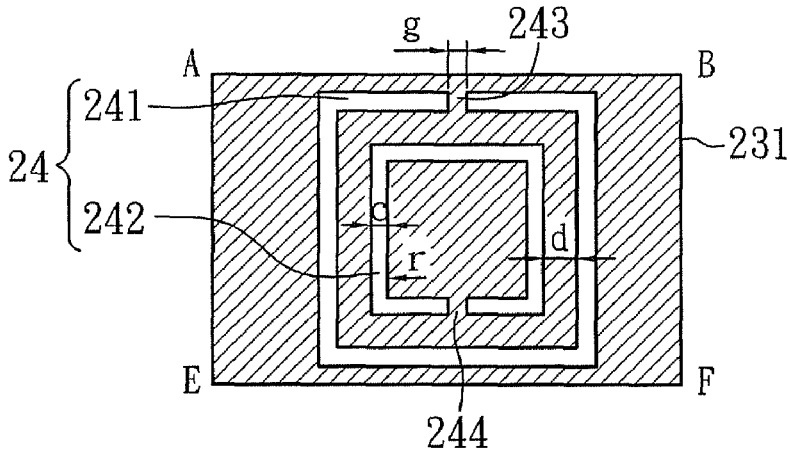
FIG. 2B (PRIOR ART)
FIG. 2B is a schematic diagram showing a "band-notched unit" of the second conventional ultra wideband antenna with band-notched characteristics.
Figure 3A:
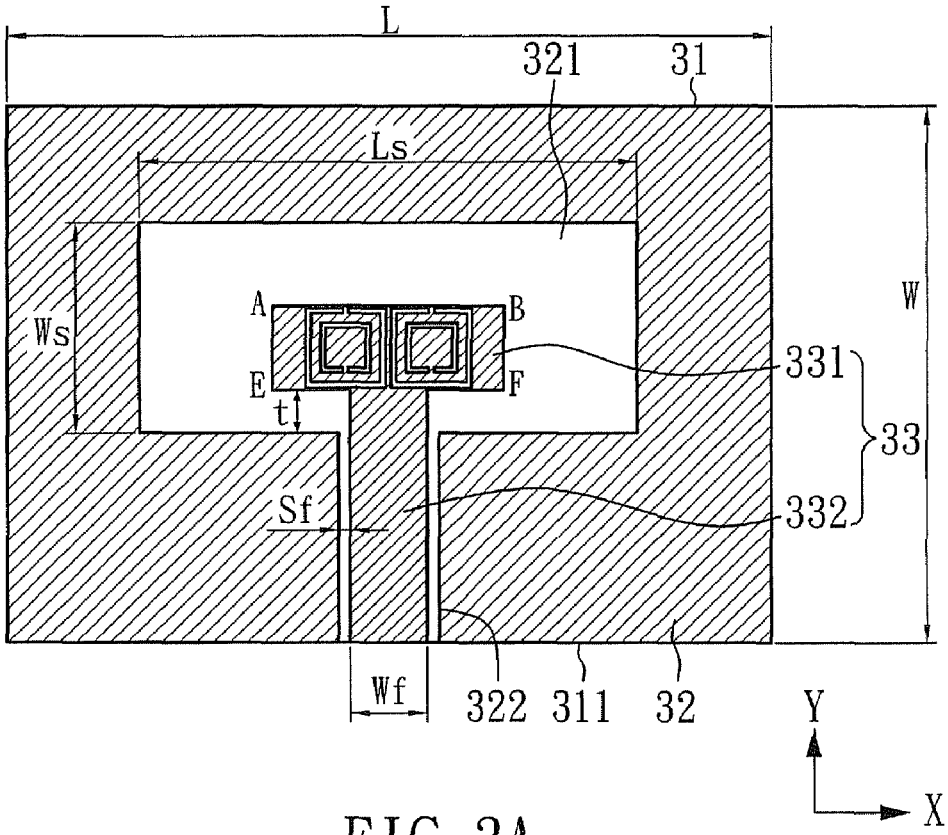
FIG. 3A (PRIOR ART)
FIG. 3A is a schematic diagram showing a third conventional ultra wideband antenna with band-notched characteristics.
Figure 3B:
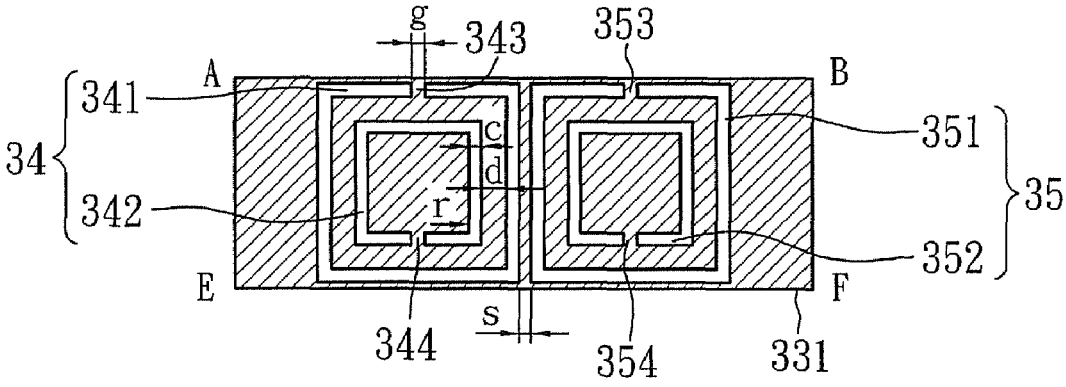
FIG. 3B (PRIOR ART)
FIG. 3B is a schematic diagram showing a "band-notched unit" of the third conventional ultra wideband antenna with band-notched characteristics.

As shown in FIG. 5, Curve A shows the variation of return loss in dependence of change of frequency for the first conventional ultra wideband antenna with band-notched characteristics as shown in FIG. 1. Curve B shows the variation of return loss in dependence of change of frequency for the second conventional ultra wideband antenna with band-notched characteristics as shown in FIG. 2. Curve C shows the variation of return loss in dependence of change of frequency for the third conventional ultra wideband antenna with band-notched characteristics as shown in FIG. 3. Curve D shows the variation of return loss in dependence of change of frequency for the ultra wideband antenna of the invention as shown in FIG. 4.

It may be seen from FIG. 5 that Curve D provides the lowest resonant frequency (about 5.5 GHz) and Curve C provides the second lowest resonant frequency (about 6.5 GHz). Therefore, in the ultra wideband antenna with band-notched characteristics of the invention, the return loss in the frequency range from 5 GHz to 6 GHz is evidently higher than that in the remaining frequency range. In addition, the return loss in the frequency range from 5 GHz to 6 GHz of the ultra wideband antenna with band-notched characteristics of the invention is the highest, as compared with that respectively of the three conventional ultra wideband antennas with band-notched characteristics, while the mismatch loss of the invention is about 4.3 dB. Such a fact reveals that in the ultra wideband antenna with band-notched characteristics of the invention, the suppression effect of the "band-notched unit" formed by connecting the first complementary, separate, circular resonator with the second complementary, separate, circular resonator is extremely good, such that the ultra wideband antenna with band-notched characteristics of the invention is able not to transmit or receive a high frequency signal in the frequency range from 5 GHz to 6 GHz.

Figure 6:
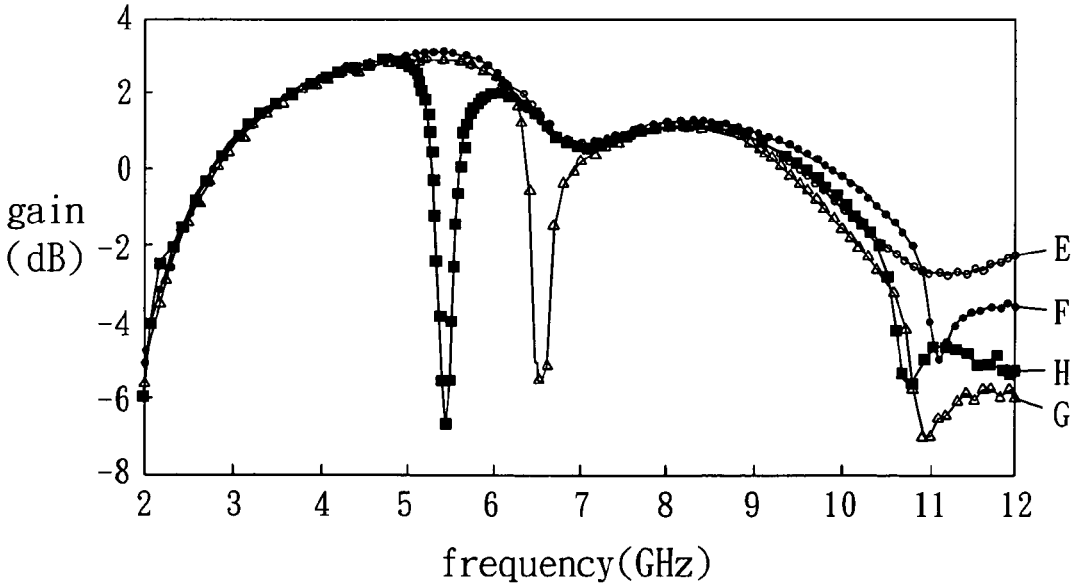
FIG. 6 is a schematic diagram showing variation of gain in dependence of change of frequency in a frequency range from 2 GHz to 12 GHz for the three conventional ultra wideband antennas with band-notched characteristics and the ultra wideband antenna with band-notched characteristics of the invention.

FIG. 6 is a schematic diagram showing variation of gain in dependence of change of frequency in a frequency range from 2 GHz to 12 GHz for the three conventional ultra wideband antennas with band-notched characteristics and the ultra wideband antenna with band-notched characteristics of the invention, which is obtained by simulation through CST software.

As shown in FIG. 6, Curve E shows the variation of gain in dependence of change of frequency for the first conventional ultra wideband antenna with band-notched characteristics as shown in FIG. 1. Curve F shows the variation of gain in dependence of change of frequency for the second conventional ultra wideband antenna with band-notched characteristics as shown in FIG. 2. Curve G shows the variation of gain in dependence of change of frequency for the third conventional ultra wideband antenna with band-notched characteristics as shown in FIG. 3. Curve H shows the variation of gain in dependence of change of frequency for the ultra wideband antenna of the invention as shown in FIG. 4.

It may be seen from FIG. 6 that Curve H provides the lowest gain value (about 5.5 GHz) and Curve G provides the second lowest gain value (about 6.5 GHz). Therefore, in the ultra wideband antenna with band-notched characteristics of the invention, the gain in the frequency range from 5 GHz to 6 GHz is evidently lower than that in the remaining frequency range. In addition, the gain in the frequency range from 5 GHz to 6 GHz of the ultra wideband antenna with band-notched characteristics of the invention is the lowest, as compared with that respectively of the three conventional ultra wideband antennas with band-notched characteristics. Such a fact reveals that in the ultra wideband antenna with band-notched characteristics of the invention, the suppression effect of the "band-notched unit" formed by connecting the first complementary, separate, circular resonator with the second complementary, separate, circular resonator is extremely good, such that the ultra wideband antenna with band-notched characteristics of the invention is able not to transmit or receive a high frequency signal in the frequency range from 5 GHz to 6 GHz.

Figure 7:
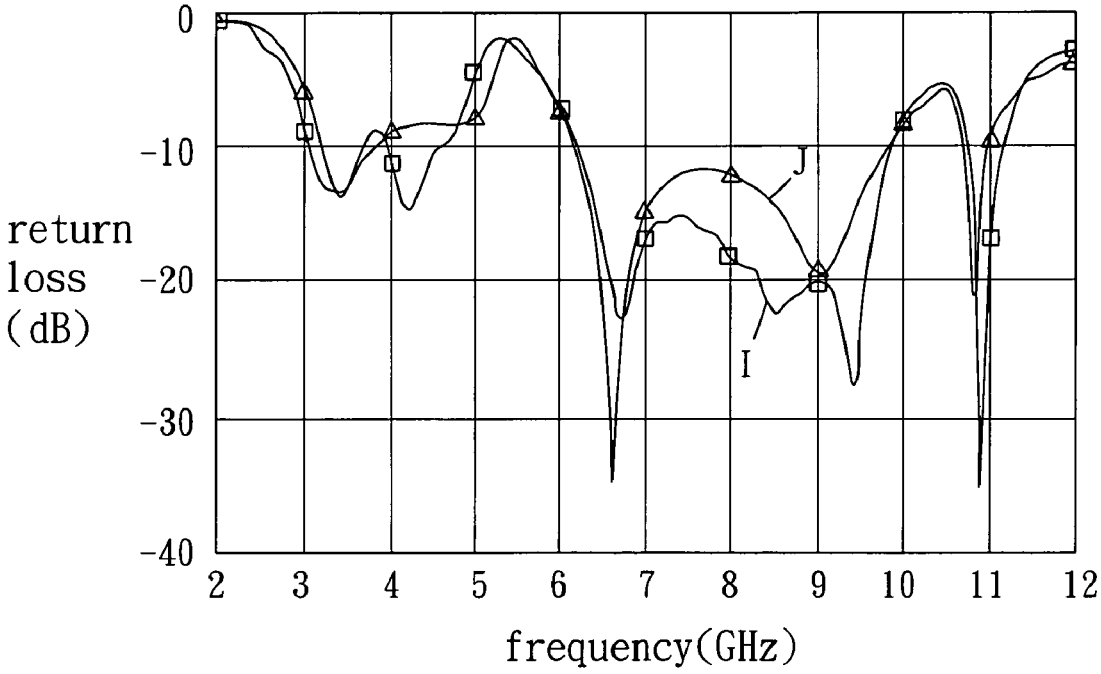
FIG. 7 is a schematic diagram showing variation of return loss in dependence of change of frequency for the ultra wideband antenna with band-notched characteristics of the invention through physical measurement and CST software simulation.

FIG. 7 is a schematic diagram showing variation of return loss in dependence of change of frequency for the ultra wideband antenna with band-notched characteristics of the invention through physical measurement and CST software simulation. As shown in FIG. 7, Curve I shows variation of the return loss in dependence of change of the frequency through physically measuring the ultra wideband antenna with band-notched characteristics of the invention. Curve J shows variation of the return loss in dependence of change of the frequency through the CST software simulation.

It may be seen from FIG. 7 that in the ultra wideband antenna with band-notched characteristics of the invention, the return loss in the frequency range from 5 GHz to 6 GHz is the highest, and such a fact is verified by that the result obtained by the CST software simulation coincides with the result obtained by the physical measurement.

In view of the above, in the ultra wideband antenna with band-notched characteristics of the invention, due to that the first complementary, separate, circular resonator and the second complementary, separate, circular resonator are installed in the horizontal portion of the signal feeding unit and are connected with each other to form a "band-notched unit", the invention will be able not to transmit or receive a high frequency signal in the frequency range from 5 GHz to 6 GHz. Thus, in operation, the ultra wideband antenna with band-notched characteristics of the invention will not interfere with the WLAN system. Further, in the ultra wideband antenna with band-notched characteristics of the invention, since the first complementary, separate, circular resonator and the second complementary, separate, circular resonator are connected with each other, the substrate area occupied by the "band-notched unit" of the invention is smaller that that of the conventional ultra wideband antennas with band-notched characteristics.

The above embodiments are merely exampled to interpret the invention for the sake of convenience. What is claimed by the invention should be based on what is described in the claims of the application, while not limited to the above embodiments.

What is claimed is:

1. An ultra wideband antenna with band-notched characteristics, comprising:

a substrate;

a grounding unit, installed on the substrate and scooped with a first slot and a first strip hole, the first strip hole being communicated with the first slot and extended to a side of the substrate;

a signal feeding unit, installed on the substrate and including a horizontal portion and a vertical portion, in which the horizontal portion is located in the first slot and the vertical portion is located in the first strip hole;

a first complementary, separate, circular resonator; and a second complementary, separate, circular resonator;

wherein the first complementary, separate, circular resonator and the second complementary, separate, circular resonator are installed in the horizontal portion of the signal feeding unit, and are connected with each other;

wherein the first complementary, separate, circular resonator includes a first rectangular strip slot and a second rectangular strip slot and the first rectangular strip slot surrounds the second rectangular strip slot;

wherein the second complementary, separate, circular resonator includes a third rectangular strip slot and a fourth rectangular strip slot and the third rectangular strip slot surrounds the fourth rectangular strip slot; and wherein the first rectangular strip slot and the third rectangular strip slot share a common side.

2. The ultra wideband antenna with band-notched characteristics as claimed in claim 1, wherein the first rectangular strip slot and the second rectangular strip slot respectively have an opening, and the direction of the opening of the first rectangular strip slot is opposite to the direction of the opening of the second rectangular strip slot.

3. The ultra wideband antenna with band-notched characteristics as claimed in claim 2, wherein the direction of the opening of the first rectangular strip slot is parallel to the extension direction of the vertical portion of the signal feeding unit.

4. The ultra wideband antenna with band-notched characteristics as claimed in claim 2, wherein the third rectangular strip slot and the fourth rectangular strip slot respectively have an opening, and the direction of the opening of the third rectangular strip slot is opposite to the direction of the opening of the fourth rectangular strip slot.

5. The ultra wideband antenna with band-notched characteristics as claimed in claim 4, wherein the direction of the opening of the first rectangular strip slot of the first complementary, separate, circular resonator is parallel to the direction of the opening of the third rectangular strip slot of the second complementary, separate, circular resonator.

6. The ultra wideband antenna with band-notched characteristics as claimed in claim 1, wherein the first rectangular strip slot of the first complementary, separate, circular resonator is communicated with the third rectangular strip slot of the second complementary, separate, circular resonator.

7. The ultra wideband antenna with band-notched characteristics as claimed in claim 1, wherein the first slot of the grounding unit is a rectangular slot hole.

8. The ultra wideband antenna with band-notched characteristics as claimed in claim 1, wherein the shape of the horizontal portion of the signal feeding unit is rectangular.

9. The ultra wideband antenna with band-notched characteristics as claimed in claim 1, wherein the substrate is a microwave substrate with FR-4 material.

10. The ultra wideband antenna with band-notched characteristics as claimed in claim 1, wherein the material respectively of the signal feeding unit and the grounding unit is metal.

11. The ultra wideband antenna with band-notched characteristics as claimed in claim 1, wherein the ultra wideband antenna with band-notched characteristics cannot transmit or receive a high frequency signal between the frequency range of 5 GHz to 6 GHz.

* * * * *